US009907400B1

(12) United States Patent
Chen et al.

(10) Patent No.: US 9,907,400 B1
(45) Date of Patent: Mar. 6, 2018

(54) RETRACTING MECHANISM FOR A MOVABLE FURNITURE PART

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Hsiu-Chiang Liang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 15/486,494

(22) Filed: Apr. 13, 2017

(30) Foreign Application Priority Data

Aug. 31, 2016 (TW) ..... 105128337 A

(51) Int. Cl.
*A47B 95/00* (2006.01)
*A47B 88/467* (2017.01)
*A47B 88/49* (2017.01)

(52) U.S. Cl.
CPC ..... *A47B 88/467* (2017.01); *A47B 88/49* (2017.01)

(58) Field of Classification Search
CPC ..... A47B 88/46; A47B 88/467; A47B 2088/4675
USPC ..... 312/333, 319.1
See application file for complete search history.

(56) References Cited

U.S. PATENT DOCUMENTS

| | | | | |
|---|---|---|---|---|
| 8,182,054 | B2 | 5/2012 | Liang et al. | |
| 8,905,498 | B2 * | 12/2014 | Hammerle | A47B 88/047 312/319.1 |
| 9,681,748 | B2 * | 6/2017 | Chen | A47B 88/453 |
| 2011/0175508 | A1 * | 7/2011 | Rechberg | E05F 3/108 312/334.8 |
| 2014/0346941 | A1 * | 11/2014 | Gasser | A47B 88/04 312/334.1 |
| 2015/0366345 | A1 * | 12/2015 | Chen | A47B 88/047 312/319.1 |

* cited by examiner

*Primary Examiner* — Matthew W Ing
(74) *Attorney, Agent, or Firm* — Rosenberg, Klein & Lee

(57) ABSTRACT

A retracting mechanism for a movable furniture part includes a body, a catching member, a connecting member, a supporting member, and a resilient member. The catching member and the body are movable with respect to each other. The connecting member is connected to the catching member, and the supporting member is connected to the connecting member. The resilient member applies an elastic restoring force to the catching member. The supporting member is engaged with the body when the body reaches a predetermined position with respect to the catching member by being moved in a certain direction. The engagement helps reduce the pulling force the operator has to apply to move the body further in the same direction with respect to the catching member.

16 Claims, 11 Drawing Sheets

RETRACTING MECHANISM FOR A MOVABLE FURNITURE PART

FIELD OF THE INVENTION

The present invention relates to a retracting mechanism and more particularly to one applicable to a movable furniture part.

BACKGROUND OF THE INVENTION

In a furniture system such as a drawer system, a drawer is typically designed to be opened and closed with respect to a cabinet frame via a pair of slide rail assemblies. According to the prior art, a drawer being moved from an opened position to a retracted position with respect to a cabinet frame can be automatically brought to the retracted position by a retracting mechanism in the last stage of the retracting process. U.S. Pat. No. 8,905,498 B2, for example, discloses a retracting device for retracting a movably supported furniture part with respect to a furniture body. The retracting device (8) includes a main body (9), an entrainment member (12), a slider (16), a spring holder (18), and a spring device (17). The main body (9) has a displacement path (10) and a control curve (21). The slider (16) is moved along the displacement path (10) in response to the entrainment member (12) being driven by a coupling element (14). The spring device (17) applies an elastic force to the spring holder (18). The spring holder (18) is configured to move along the control curve (21) and has a tooth arrangement (22*a*) engageable with a tooth arrangement (22*b*) of the slider (16). The foregoing configuration allows the forces required for stressing the spring device (17) to be reduced. The contents of this US patent are incorporated herein by reference.

As market demands vary, it is important for the related industries to work together and develop more retracting devices that are equally capable of reducing the forces required to move a furniture part with respect to another.

SUMMARY OF THE INVENTION

The present invention relates to a retracting mechanism that allows a user to operate a movable furniture part effortlessly.

According to one aspect of the present invention, a retracting mechanism includes a body, a catching member, a connecting member, a supporting member, and a resilient member. The body includes a first path and a second path. The first path includes a guiding section with opposite first and second ends, and there is a height difference between the first and second ends. The first path further includes a first bent section adjacent to the second end of the guiding section. The second path includes a linear section and a second bent section. The second bent section is bent with respect to and in communication with the linear section. The catching member and the body can move with respect to each other through the second path. The connecting member is connected to the catching member. The supporting member is connected to the connecting member and includes a supporting portion in the first path. The resilient member is configured to apply an elastic restoring force to the catching member. When one of the body and the catching member reaches a first predetermined position with respect to the other by being moved in a first direction, the supporting portion of the supporting member is moved from the guiding section of the first path of the body into engagement with the first bent section. When the one of the body and the catching member reaches a second predetermined position with respect to the other by being further moved in the first direction, the catching member is moved from the linear section of the second path of the body into engagement with the second bent section to maintain the elastic restoring force of the resilient member, wherein the elastic restoring force acts in a second direction.

Preferably, the retracting mechanism is applicable to a first furniture part and a second furniture part, wherein the first furniture part includes a fixing member and the second furniture part is movable in the first direction from a retracted position with respect to the first furniture part. The elastic restoring force is able to retract the second furniture part to the retracted position with respect to the first furniture part. The connecting member and the catching member are pivotally connected. The supporting member and the connecting member are pivotally connected. When the second furniture part reaches a first predetermined position with respect to the first furniture part by being moved in the first direction from the retracted position, the supporting portion of the supporting member is pivoted with respect to the connecting member from the guiding section of the first path of the body into engagement with the first bent section. When the second furniture part reaches a second predetermined position with respect to the first furniture part by being further moved in the first direction from the first predetermined position, the catching member is pivoted with respect to the connecting member, is thereby disengaged from the fixing member of the first furniture part, and is moved from the linear section of the second path of the body into engagement with the second bent section to maintain the elastic restoring force of the resilient member.

Preferably, the resilient member is mounted between the supporting member and the body.

Preferably, the guiding section is sloped.

Preferably, the connecting member and the catching member are pivotally connected by a first shaft, wherein the first shaft is in the second path.

Preferably, the supporting member and the connecting member are pivotally connected by a pivotal connection portion, wherein the pivotal connection portion is in the second path.

Preferably, the supporting portion of the supporting member can be pressed against the guiding section in order to move along the guiding section and approach the first bent section progressively.

Preferably, the retracting mechanism further includes a buffer device arranged between the body and the catching member.

Preferably, the second direction and the first direction are opposite directions.

According to another aspect of the present invention, a retracting mechanism includes a body, a catching member, a connecting member, a supporting member, and a resilient member. The body includes a first engaging portion and a second engaging portion. The catching member and the body can move with respect to each other. The connecting member and the catching member are pivotally connected. The supporting member and the connecting member are pivotally connected. The supporting member includes a supporting portion. While one of the body and the catching member is being moved with respect to the other in a first direction, the resilient member accumulates an elastic restoring force in a second direction. When the one of the body and the catching member reaches a first predetermined position with respect to the other by being moved in the first direction, the supporting portion of the supporting member is pivoted with respect to the connecting member into engagement with the first engaging portion of the body. While the one of the body and the catching member is being further moved with respect to the other in the first direction, the supporting portion of the supporting member is engaged with the first engaging portion of the body to help overcome the elastic restoring force of the resilient member in the second direction. When the one of the body and the catching member reaches a second predetermined position by being further moved with respect to the other in the first direction, the catching member is pivoted with respect to the connecting member into engagement with the second engaging portion of the body to maintain the elastic restoring force of the resilient member in the second direction.

DETAILED DESCRIPTION OF THE INVENTION

Figure 1:
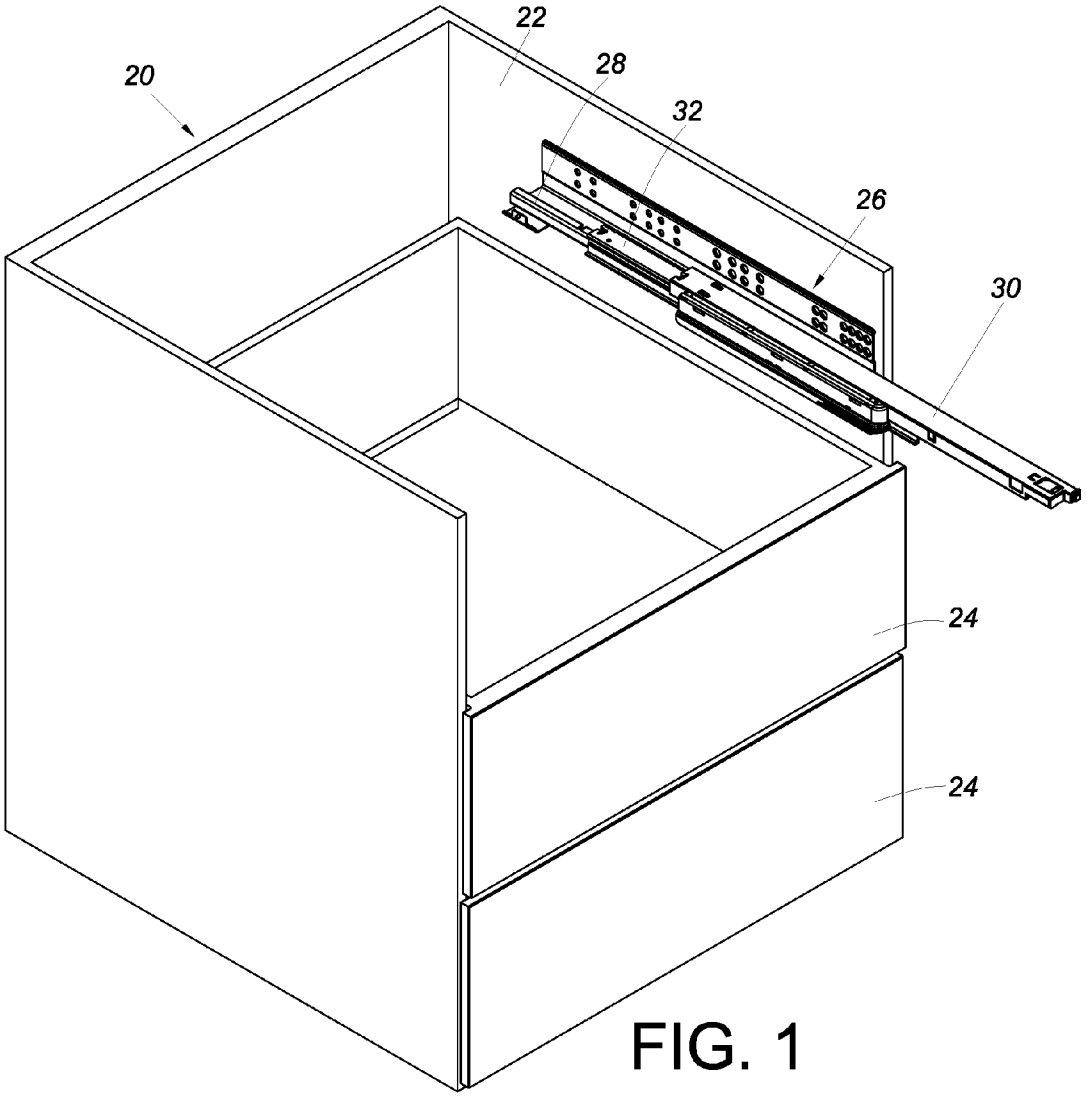
FIG. 1 is a perspective view of the furniture system in an embodiment of the present invention, with the uppermost drawer removed.

Referring to FIG. 1, the furniture system 20 in an embodiment of the present invention includes a cabinet frame 22 and at least one drawer 24. Here, a plurality of drawers 24 are provided by way of example. Preferably, each drawer 24 is mounted to the cabinet frame 22 by a pair of slide rail assemblies 26. More specifically, each slide rail assembly 26 includes a first rail 28 and a second rail 30 longitudinally movable with respect to the first rail 28. Each slide rail assembly 26 preferably further includes a third rail 32 for increasing the maximum distance for which the corresponding second rail 30 can be moved with respect to the corresponding first rail 28. The first rails 28 are connected (e.g., fixedly connected) to the cabinet frame 22. The second rails 30 are configured to support the drawers 24 so that each drawer 24 can be easily opened and closed with respect to the cabinet frame 22 or the corresponding first rails 28 via the corresponding second rails 30. In this embodiment, and by way of example, an arbitrary one of the first rails 28 (or the cabinet frame 22) is referred to as the first furniture part, and the corresponding second rail 30 (or the corresponding drawer 24) is referred to as the second furniture part. In practice, however, the first furniture part and the second furniture part are not limited to the foregoing.

Figure 2:
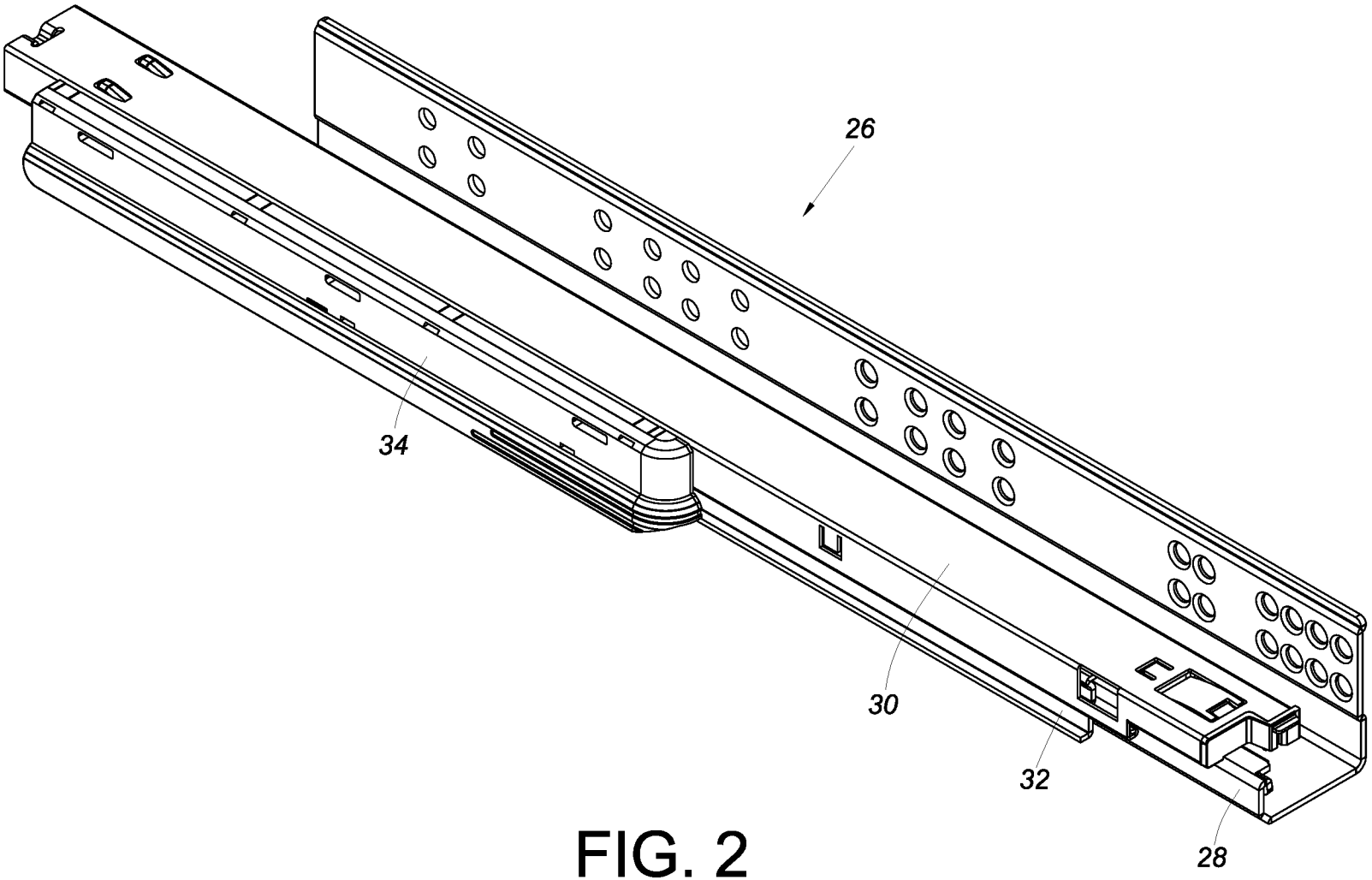
FIG. 2 is a perspective view of a slide rail assembly in an embodiment of the present invention.

FIG. 2 shows a retracting mechanism 34 in this embodiment. The retracting mechanism 34 is applied to the first furniture part and the second furniture part (e.g., the first rail 28 and the second rail 30 of the slide rail assembly 26 shown) of the furniture system 20.

Figure 3:
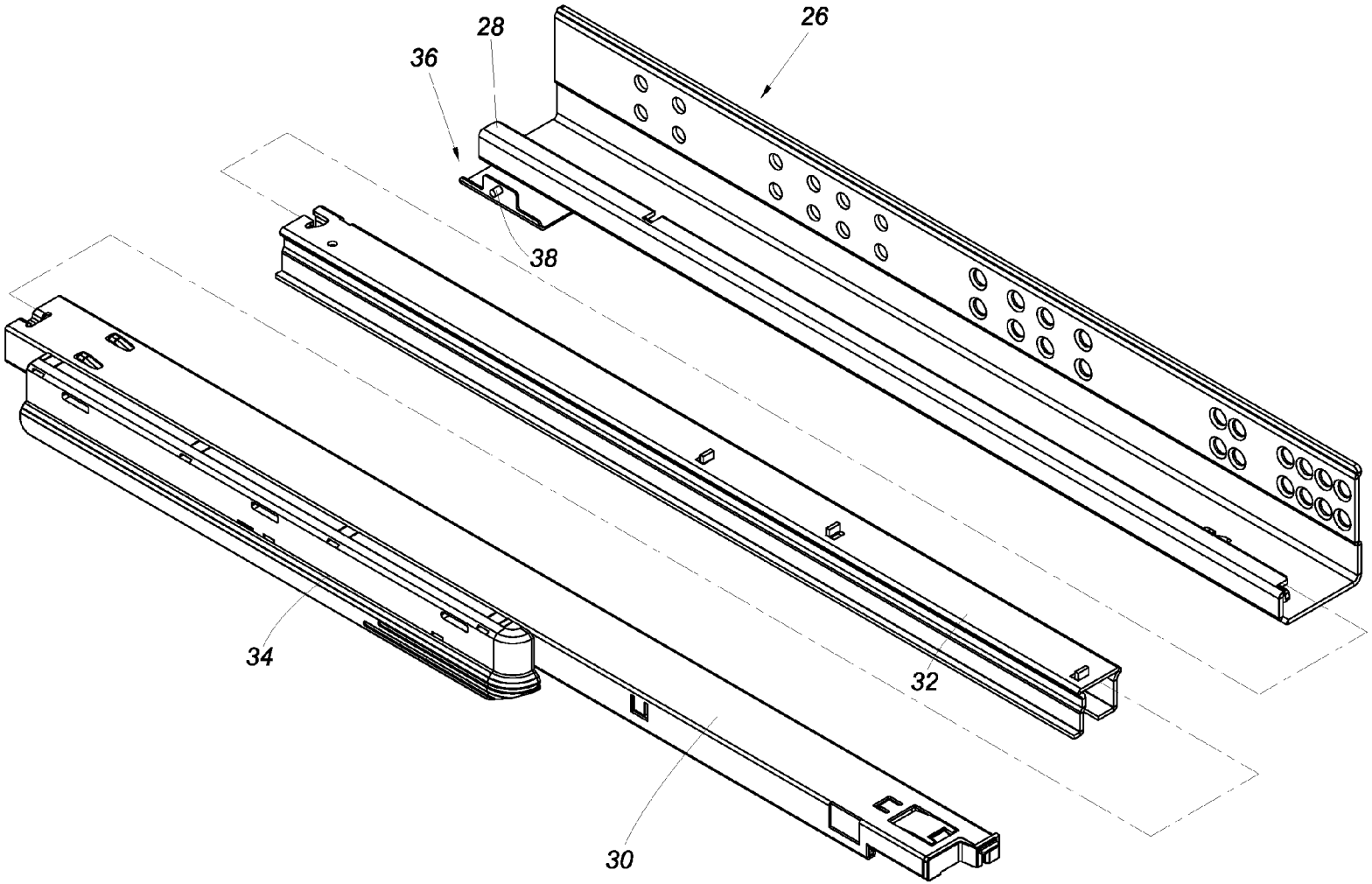
FIG. 3 is an exploded perspective view of the slide rail assembly in an embodiment of the present invention.

As shown in FIG. 3, the third rail 32 of the slide rail assembly 26 is movably mounted between the first rail 28 and the second rail 30. Furthermore, the first rail 28 includes a fixing member 36 with a fixing portion 38. Here, the fixing member 36 is fixedly connected to the first rail 28 at a position adjacent to the rear end of the first rail 28. The retracting mechanism 34, on the other hand, is arranged on the second rail 30 by way of example; that is to say, the retracting mechanism 34 can be moved with respect to the first rail 28 along with the second rail 30.

Figure 4:
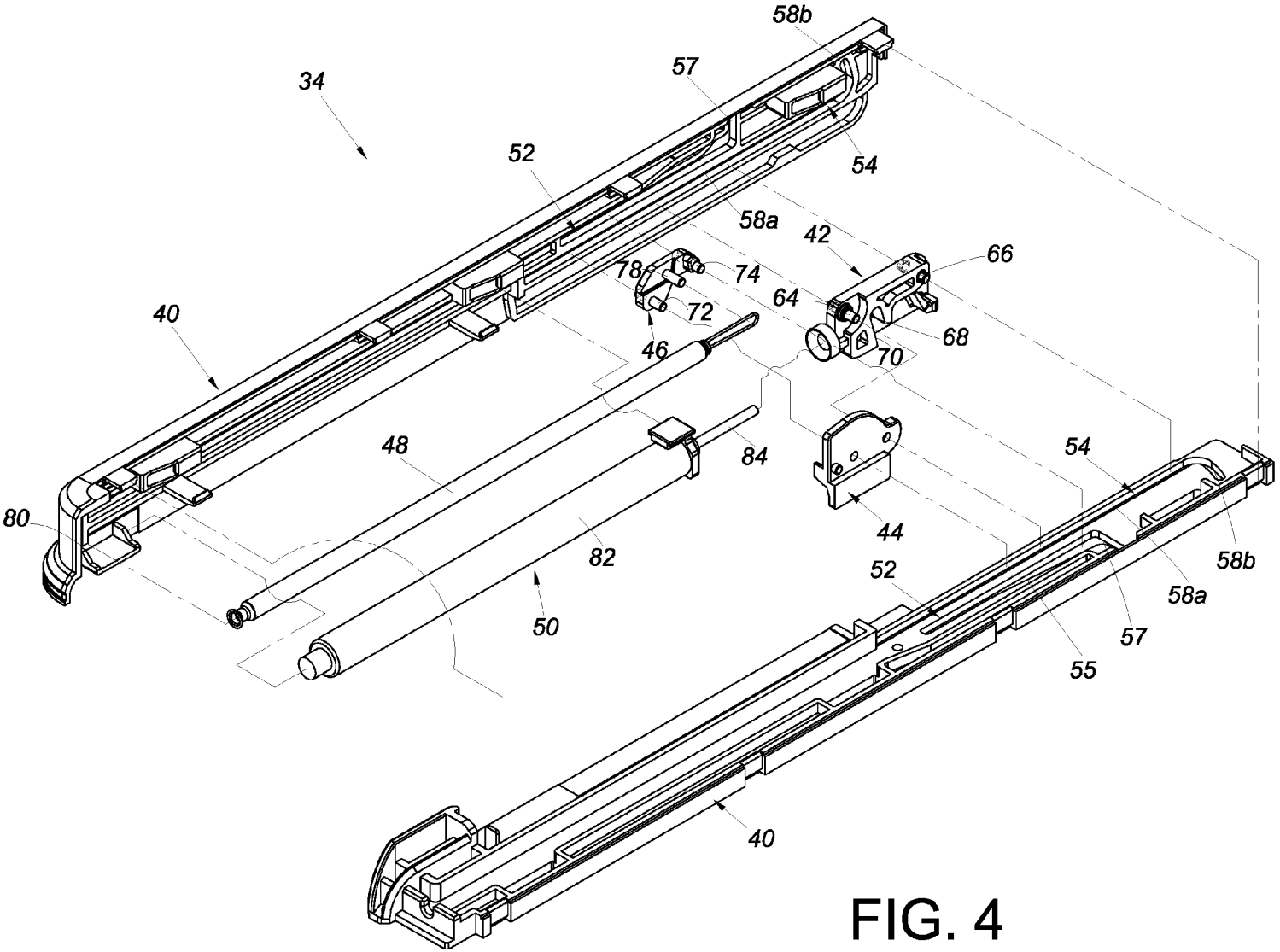
FIG. 4 is an exploded perspective view of the retracting mechanism in an embodiment of the present invention.
Figure 5:
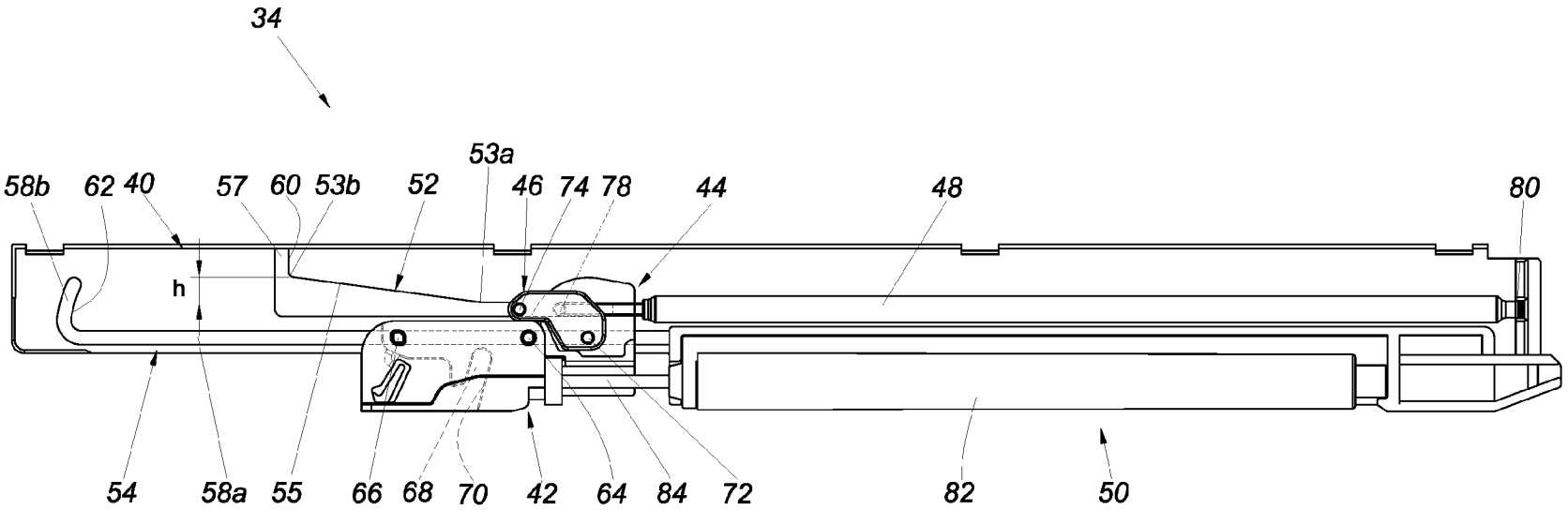
FIG. 5 is an assembled view of the retracting mechanism in an embodiment of the present invention.

Referring to FIG. 4 and FIG. 5, the retracting mechanism 34 includes at least one body 40, a catching member 42, a connecting member 44, a supporting member 46, and a resilient member 48. Preferably, the retracting mechanism 34 further includes a buffer device 50.

In this embodiment, the retracting mechanism 34 has two bodies 40 by way of example, and the two bodies 40 are assembled together by a connecting means such as mechanical engagement, fastening, or threaded connection, without limitation. The two bodies 40 have substantially corresponding structural configurations and each serve as a structure where the catching member 42, the connecting member 44, the supporting member 46, the resilient member 48, and/or the buffer device 50 can be mounted.

Figure 7:
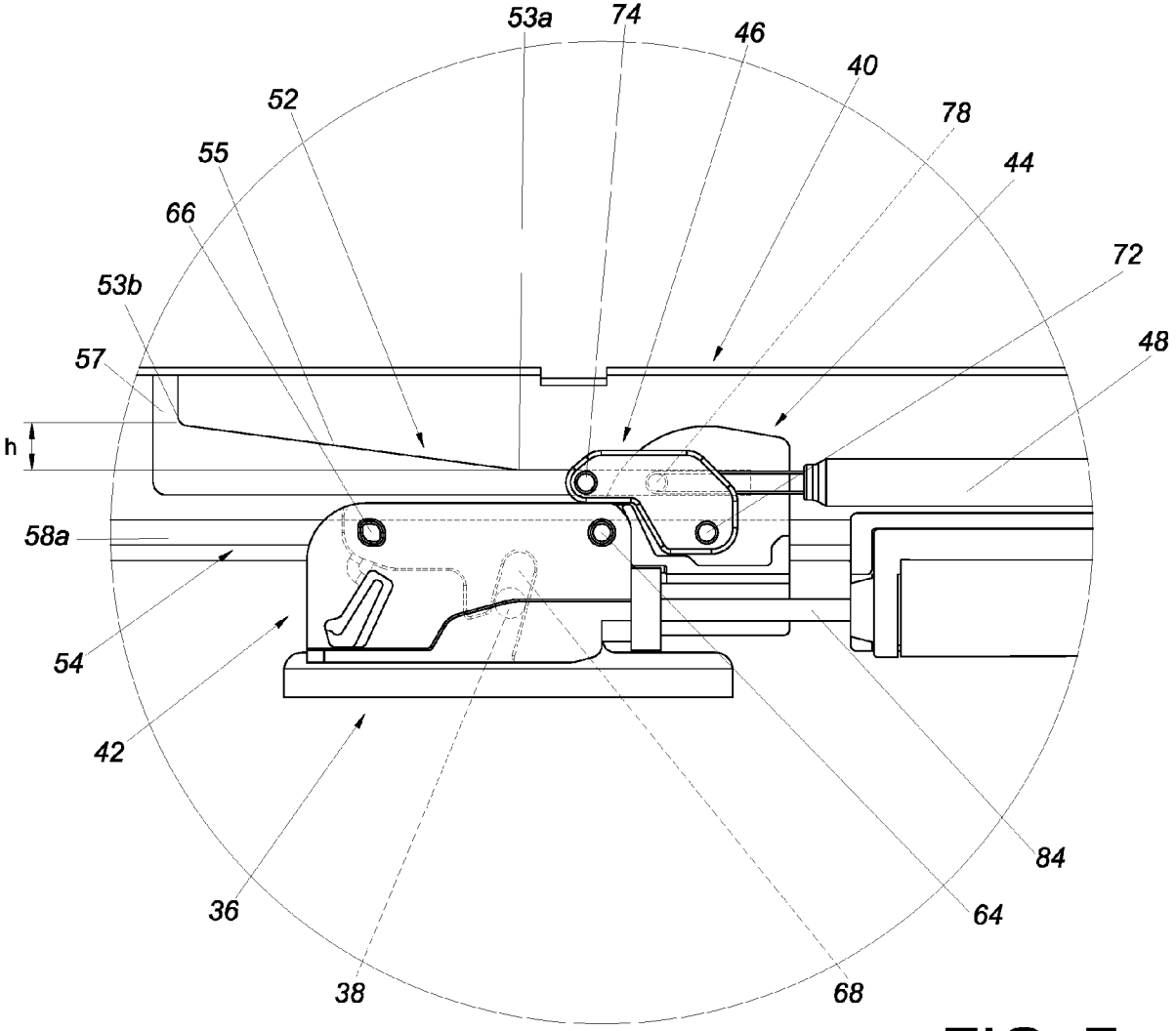
FIG. 7 is an enlarged view of the circled area A in FIG. 6.

Each body 40 includes a first path 52 and a second path 54 spaced apart from the first path 52 (see FIG. 5 and FIG. 7). The first path 52 includes a guiding section 55 with a first end 53*a* and a second end 53*b*. The second end 53*b* is opposite and away from the first end 53*a*, and there is a height difference h between the first end 53*a* and the second end 53*b*. The guiding section 55 is preferably sloped and may be an inclined or curved surface for example. The first path 52 further includes a first bent section 57 adjacent to the second end 53*b* of the guiding section 55. The second path 54 includes a linear section 58*a* and a second bent section 58*b*, wherein the second bent section 58*b* is curved with respect to and in communication with the linear section 58*a*. The linear section 58*a* of the second path 54 has a greater length than the guiding section 55 of the first path 52. In this embodiment, each body 40 further includes a first engaging portion 60 and a second engaging portion 62. The first engaging portion 60 is adjacent to the first bent portion 57 while the second engaging portion 62 is adjacent to the second bent section 58*b*.

Referring to FIG. 4 and FIG. 5, the catching member 42 and the bodies 40 can move with respect to each other. For example, the catching member 42 and the bodies 40 can move with respect to each other via the second paths 54. The catching member 42 is connected to the connecting member 44. For example, the catching member 42 and the connecting member 44 are pivotally connected by a first shaft 64. In this embodiment, and by way of example, the catching member 42 includes the first shaft 64 to enable pivotal connection with the connecting member 44. The first shaft 64 is in the second paths 54, e.g., in the linear sections 58*a* of the second paths 54. Here, the catching member 42 further includes a second shaft 66, a catching feature 68, and a disengaging feature 70. The second shaft 66 is also in the second paths 54. The catching feature 68 is an engaging structure, and the disengaging feature 70 is a wall, both by way of example.

The supporting member 46 is connected to the connecting member 44. For example, the supporting member 46 and the connecting member 44 are pivotally connected by a pivotal connection portion 72. Here, by way of example, the supporting member 46 includes the pivotal connection portion 72 to enable pivotal connection with the connecting member 44. The pivotal connection portion 72 is in the second paths 54, e.g., in the linear sections 58*a* of the second paths 54. Besides, the supporting member 46 includes a supporting portion 74 in the first paths 52. Preferably, the supporting member 46 further includes a mounting portion 78.

The resilient member 48 is configured to apply an elastic restoring force acting between the catching member 42 and the bodies 40. For example, the resilient member 48 is mounted between the supporting member 46 (e.g., the mounting portion 78 of the supporting member 46) and connecting portions 80 of the bodies 40.

The buffer device 50 is arranged between the bodies 40 and the catching member 42 and includes a cylinder 82 and a buffer rod 84, wherein the buffer rod 84 is configured to be pressed against the catching member 42. As the working principle of the buffer device 50 is well known in the art, further description is omitted herein for the sake of brevity.

Figure 6:
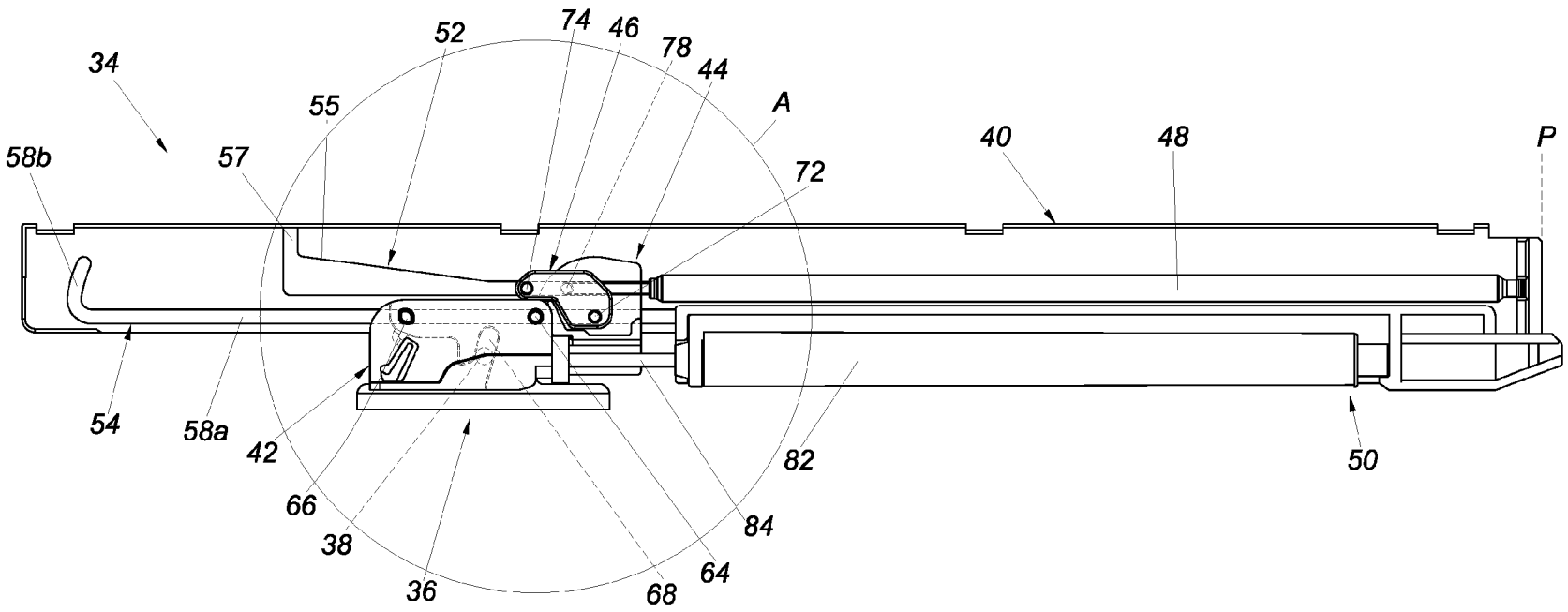
FIG. 6 shows that a body of the retracting mechanism in an embodiment of the present invention is at a retracted position with respect to the catching member.

Referring to FIG. 6 and FIG. 7, the retracting mechanism 34, which is arranged on one of the second rails 30 of the furniture system 20 and can therefore be used to represent the second rail 30, is shown at a retracted position P with respect to the fixing member 36, which is part of the corresponding first rail 28 and can therefore be used to represent the corresponding first rail 28. That is to say, in the state shown in FIG. 6 and FIG. 7, the second rail 30 corresponding to the retracting mechanism 34 is at the retracted position P with respect to the first rail 28 corresponding to the fixing member 36.

More specifically, when the second rail 30 corresponding to the retracting mechanism 34 in FIG. 6 and FIG. 7 is at the retracted position P with respect to the first rail 28 corresponding to the fixing member 36 in FIG. 6 and FIG. 7, the catching feature 68 of the catching member 42 of the retracting mechanism 34 is engaged with the fixing portion 38 of the fixing member 36 of the first rail 28. Moreover, the catching member 42 responds to the elastic restoring force of the resilient member 48 by keeping the retracting mechanism 34 at the retracted position P. On the other hand, the buffer rod 84 of the buffer device 50 is in a retracted state with respect to the cylinder 82.

Figure 8:
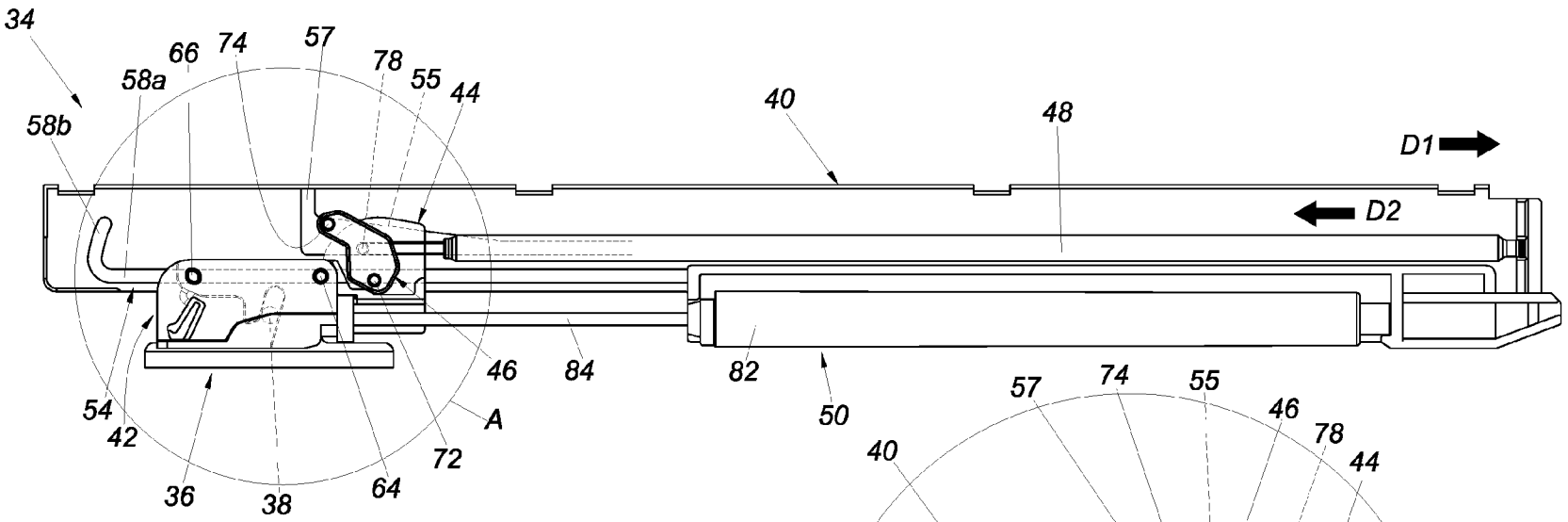
FIG. 8 shows the body in an embodiment of the present invention moved in a first direction from the retracted position with respect to the catching member.

Referring to FIG. 8 in conjunction with FIG. 6, one of the body 40 and the catching member 42 is moved with respect to the other in a first direction D1. In this embodiment, when a user applies an operating force to the second rail 30 and thereby moves the second rail 30 in the first direction D1 from the retracted position P with respect to the first rail 28, the body 40 is moved in the first direction D1 with respect to the catching member 42 due to the fact that the catching member 42 is engaged with the fixing portion 38 of the fixing member 36 of the first rail 28.

Figure 9:
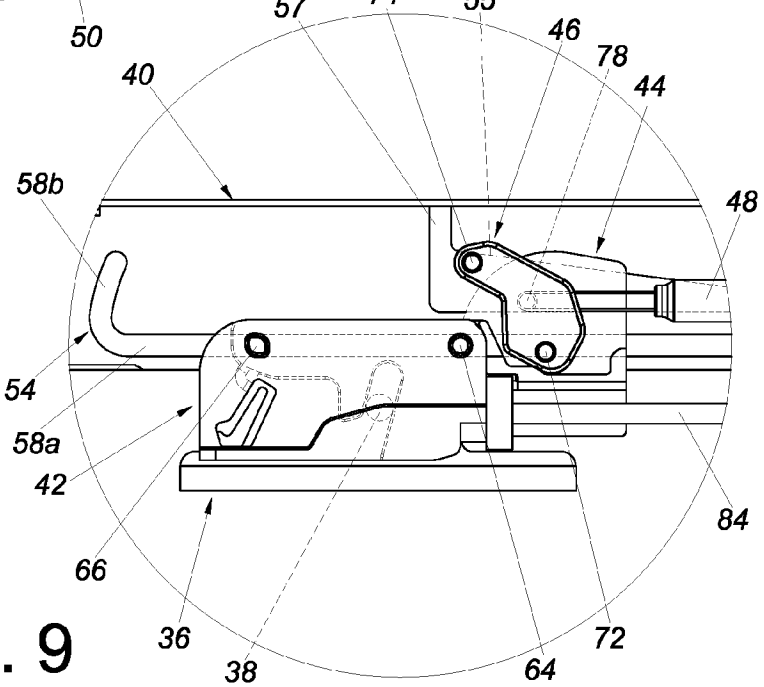
FIG. 9 is an enlarged view of the circled area A in FIG. 8.

More specifically, in the course in which the body 40 is moved in the first direction D1 with respect to the catching member 42, the resilient member 48 accumulates an elastic restoring force in a second direction D2 in response to the movement of the body 40, wherein the second direction D2 is the opposite direction of the first direction D1. (The user's operating force, therefore, must be greater than the elastic restoring force of the resilient member 48 in order to move the body 40 in the first direction D1.) On the other hand, the buffer rod 84 of the buffer device 50 is gradually extended with respect to the cylinder 82. Moreover, in response to the body 40 moving in the first direction D1, the second shaft 66 of the catching member 42 is moved along the linear section 58*a* of the second path 54 of the body 40 and thus approaches the second bent section 58*b* gradually, and the supporting portion 74 of the supporting member 46 is moved along the guiding section 55 of the first path 52 of the body 40 and thus approaches the first bent section 57 gradually. The supporting portion 74 of the supporting member 46 is preferably pressed against the guiding section 55 so as to approach the first bent section 57 progressively along the guiding section 55 (see FIG. 9).

Figure 10:
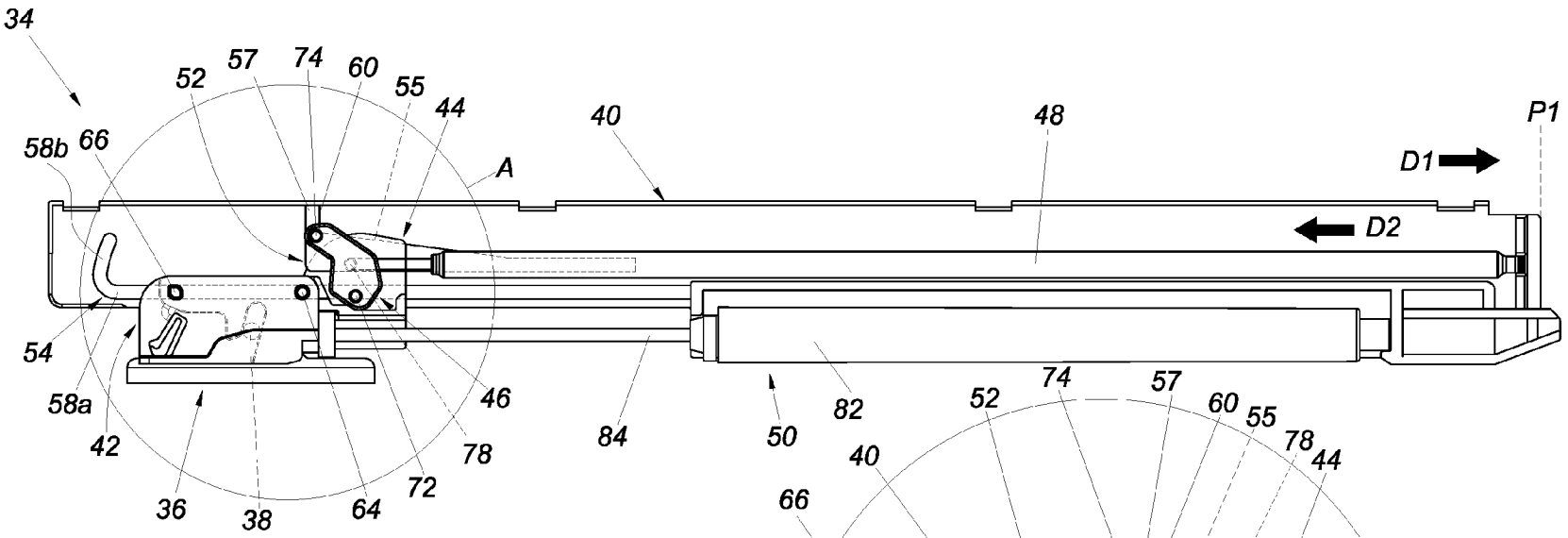
FIG. 10 shows the body in an embodiment of the present invention reaching a first predetermined position with respect to the catching member after being moved in the first direction.
Figure 11:
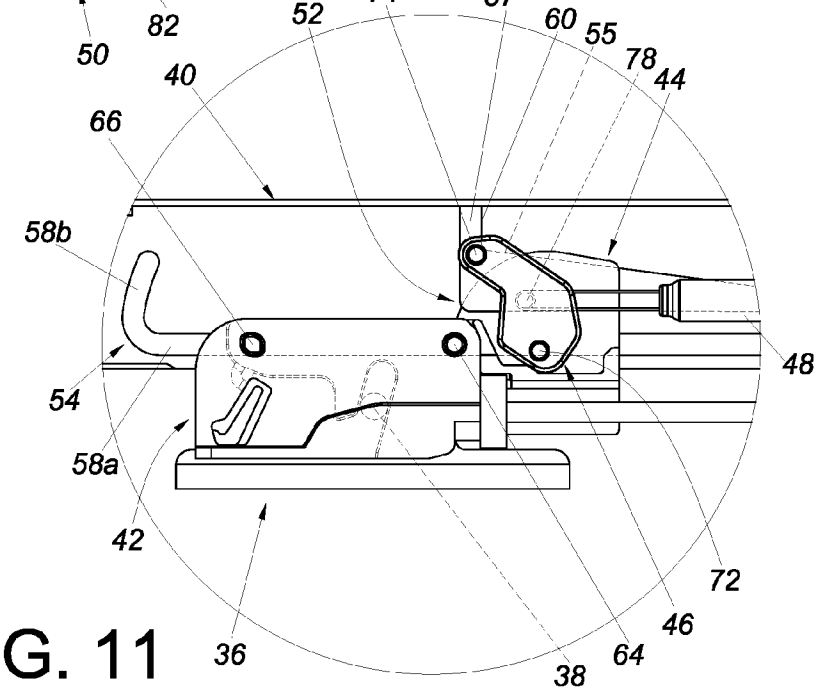
FIG. 11 is an enlarged view of the circled area A in FIG. 10.

Referring to FIG. 10 in conjunction with FIG. 8, when the body 40 is further moved in the first direction D1 and reaches a first predetermined position P1 with respect to the catching member 42, the second shaft 66 of the catching member 42 can be further moved along the linear section 58*a* of the second path 54 of the body 40 to approach the second bent section 58*b* gradually. On the other hand, the supporting portion 74 of the supporting member 46 is pivoted with respect to the connecting member 44 along the guiding section 55, enters the first bent section 57, and becomes engaged with the first engaging portion 60. In other words, the supporting portion 74 of the supporting member 46 is moved from the guiding section 55 of the first path 52 of the body 40 into engagement with the first bent section 57 (see FIG. 9 and FIG. 11).

Figure 12:
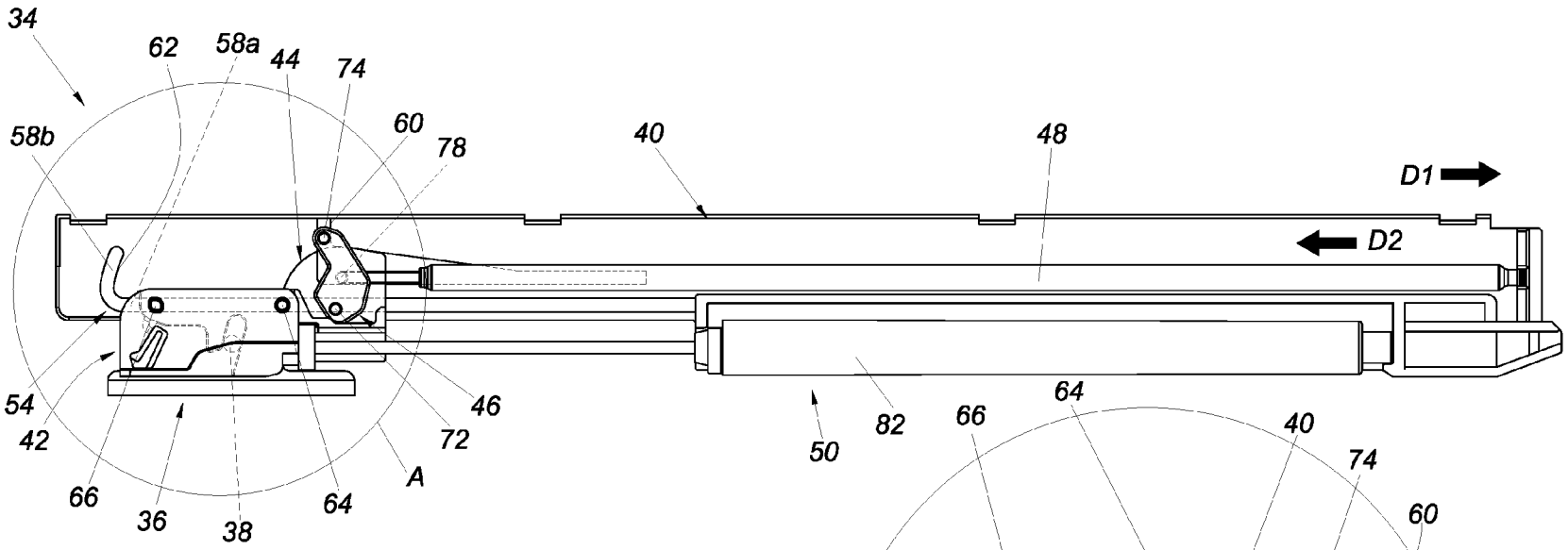
FIG. 12 shows the body in an embodiment of the present invention further moved with respect to the catching member in the first direction.
Figure 13:
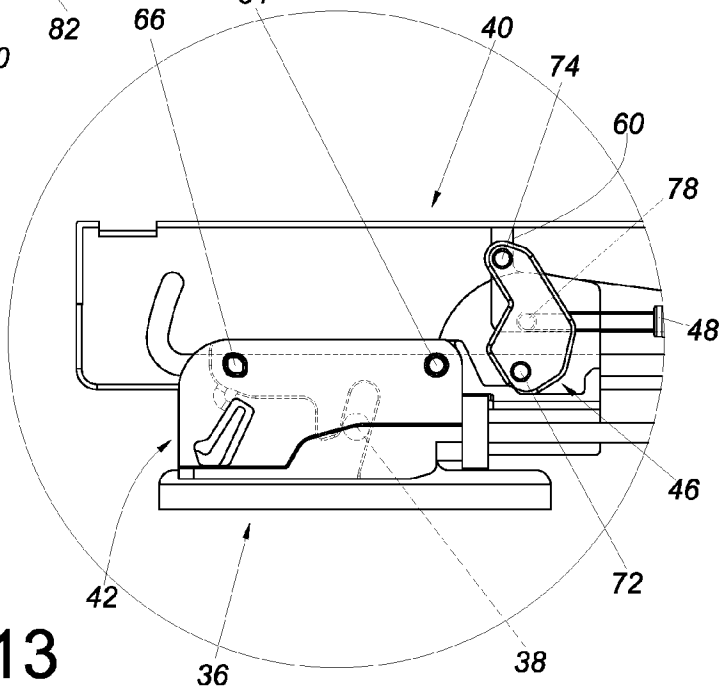
FIG. 13 is an enlarged view of the circled area A in FIG. 12.

Referring to FIG. 12 in conjunction with FIG. 10, while the body 40 is being further moved in the first direction D1 from the first predetermined position P1 with respect to the catching member 42, the supporting portion 74 of the supporting member 46 is engaged with the first engaging portion 60 of the body 40 to enable the body 40 to overcome the elastic restoring force of the resilient member 48, which force acts in the second direction D2. That is to say, with the supporting portion 74 of the supporting member 46 engaged with the first engaging portion 60 and serving as a fulcrum to provide leverage, the operating force required to be applied to the second rail 30 or the body 40 can be reduced, allowing the operator to move the second rail 30 or the body 40 in the first direction D1 with ease (see FIG. 13).

Figures 14, 15:
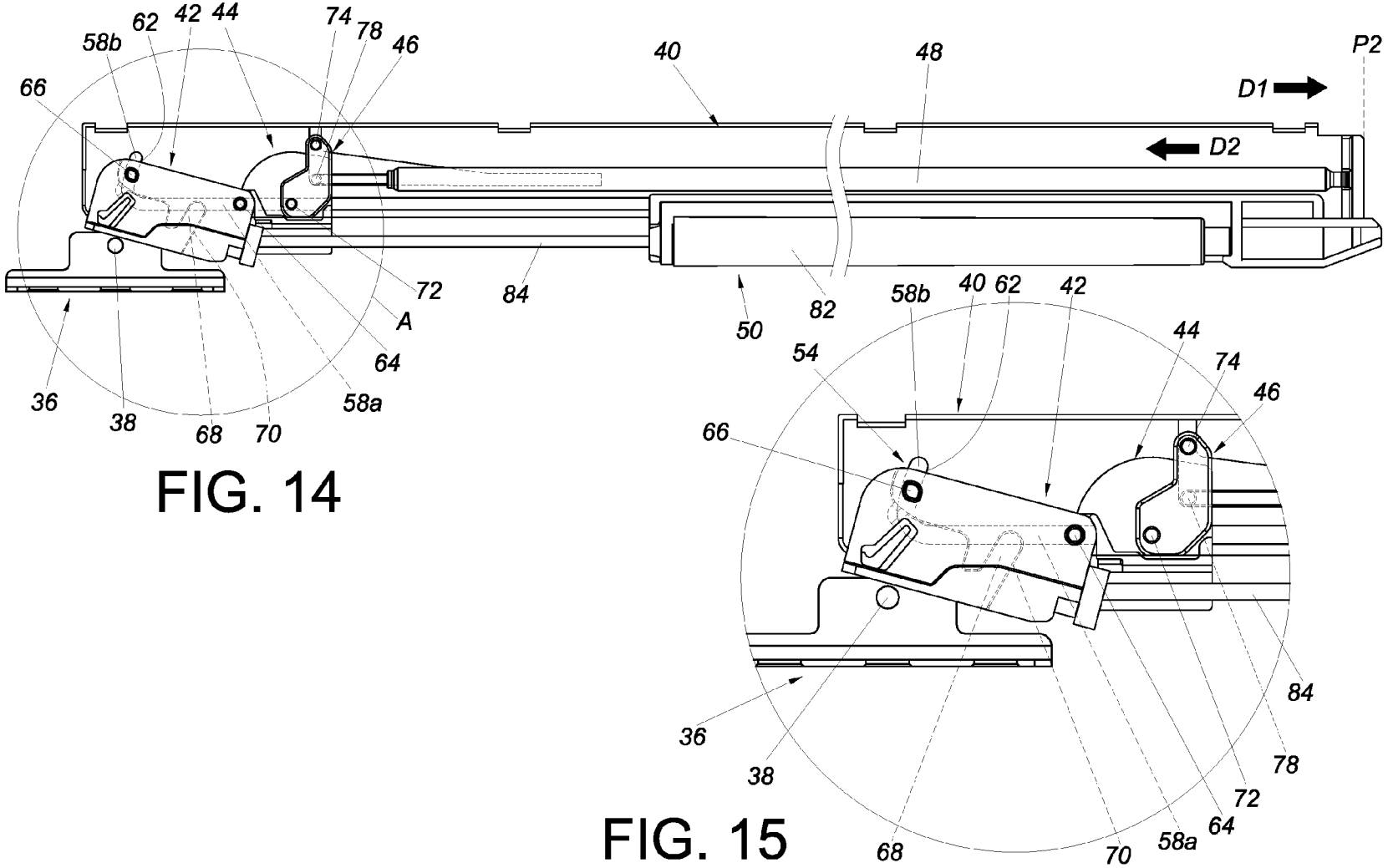
FIG. 14 shows the body in an embodiment of the present invention reaching a second predetermined position with respect to the catching member after being further moved in the first direction.
FIG. 15 is an enlarged view of the circled area A in FIG. 14.

Referring to FIG. 14 in conjunction with FIG. 12, when the body 40 is further moved in the first direction D1 and reaches a second predetermined position P2 with respect to the catching member 42, the catching member 42 is pivoted with respect to the connecting member 44 and is thereby disengaged from the fixing portion 38 of the fixing member 36 of the first rail 28, and the second shaft 66 of the catching member 42 is engaged with the second engaging portion 62 of the body 40. Thus, the catching member 42 is moved from the linear section 58*a* of the second path 54 of the body 40 into engagement with the second bent section 58*b* (see FIG. 15) to maintain the elastic restoring force of the resilient member 48, which force acts in the second direction D2. On the other hand, the supporting member 46 is further pivoted with respect to the connecting member 44, and the buffer rod 84 of the buffer device 50 is fully extended with respect to the cylinder 82 into a buffer-ready state.

It is worth mentioning that, when the second rail 30 is subsequently retracted in the second direction D2 from the second predetermined position P2 toward the retracted position P with respect to the first rail 28 and enters the last stage of the retracing process, the disengaging feature 70 of the catching member 42 comes into contact with the fixing portion 38 of the fixing member 36 of the first rail 28, thus bringing the catching feature 68 of the catching member 42 into engagement with the fixing portion 38 of the fixing member 36 again, allowing the resilient member 48 to release its elastic restoring force, which acts in the second direction D2. Consequently, the second rail 30 is retracted with respect to the first rail 28 in the second direction D2 until the retracted position P is reached, and the body 40 is thus retracted in the second direction D2 to the retracted position P with respect to the catching member 42 (the process of which can be understood by referring sequentially to FIG. 12, FIG. 10, FIG. 8, and FIG. 6). In addition, the buffer device 50 provides a buffering effect during the process of retraction toward the retracted position P. As the buffering mechanism is well known in the art, a detailed description thereof is omitted herein for the sake of brevity.

While the present invention has been disclosed through the foregoing preferred embodiment, it should be understood that the embodiment is not intended to be restrictive of the scope of the invention. The scope of patent protection sought by the applicant is defined by the appended claims.

What is claimed is:

1. A retracting mechanism, comprising:

a body including a first path and a second path, wherein the first path includes a guiding section, the guiding section includes a first end and a second end opposite the first end, there is a height difference between the first end and the second end, the first path further includes a first bent section adjacent to the second end of the guiding section, and the second path includes a linear section and a second bent section bent with respect to and in communication with the linear section;

a catching member, wherein the catching member and the body are movable with respect to each other through the second path;

a connecting member connected to the catching member;

a supporting member connected to the connecting member, the supporting member including a supporting portion in the first path, and the supporting member and the connecting member are pivotally connected by a pivotal connection portion, the pivotal connection portion is in the second path; and a resilient member for applying an elastic restoring force to the catching member;

wherein the supporting portion of the supporting member is moved from the guiding section of the first path of the body into engagement with the first bent section when one of the body and the catching member reaches a first predetermined position with respect to the other by being moved in a first direction;

wherein the catching member is moved from the linear section of the second path of the body into engagement with the second bent section to maintain the elastic restoring force of the resilient member, when the one of the body and the catching member reaches a second predetermined position with respect to the other by being further moved in the first direction, the elastic restoring force acting in a second direction.

2. The retracting mechanism of claim 1, wherein the guiding section is sloped.

3. The retracting mechanism of claim 1, wherein the connecting member and the catching member are pivotally connected by a shaft, and the shaft is in the second path.

4. The retracting mechanism of claim 1, wherein the supporting portion of the supporting member is able to be pressed against the guiding section in order to move along the guiding section and approach the first bent section gradually.

5. The retracting mechanism of claim 1, further comprising a buffer device arranged between the body and the catching member.

6. The retracting mechanism of claim 1, wherein the second direction and the first direction are opposite directions.

7. A retracting mechanism, comprising:

a body including a first engaging portion, a second engaging portion, a first path and a second path, the first path includes a guiding section and a first bent section adjacent to the guiding section, the second path includes a linear section and a second bent section bent with respect to and in communication with the linear section, the first engaging portion is adjacent to the first bent section, and the second engaging portion is adjacent to the second bent section;

a catching member, wherein the catching member and the body are movable with respect to each other;

a connecting member, wherein the connecting member and the catching member are pivotally connected;

a supporting member, wherein the supporting member and the connecting member are pivotally connected, and the supporting member includes a supporting portion, the supporting member and the connecting member are pivotally connected by a pivotal connection portion, and the pivotal connection portion is in the second path; and a resilient member;

wherein the resilient member accumulates an elastic restoring force in a second direction while one of the body and the catching member is being moved with respect to the other in a first direction, and the supporting portion of the supporting member is pivoted with respect to the connecting member into engagement with the first engaging portion of the body when the one of the body and the catching member reaches a first predetermined position with respect to the other by being moved in the first direction;

wherein the supporting portion of the supporting member is engaged with the first engaging portion of the body while the one of the body and the catching member is being further moved with respect to the other in the first direction, thus assisting in overcoming the elastic restoring force of the resilient member in the second direction; and the catching member is pivoted with respect to the connecting member into engagement with the second engaging portion of the body when the one of the body and the catching member reaches a second predetermined position by being further moved with respect to the other in the first direction, thus maintaining the elastic restoring force of the resilient member in the second direction.

8. The retracting mechanism of claim 7, wherein the resilient member is mounted between the supporting member and the body.

9. The retracting mechanism of claim 7, wherein the guiding section is sloped.

10. The retracting mechanism of claim 7, wherein the connecting member and the catching member are pivotally connected by a shaft, and the shaft is in the second path.

11. The retracting mechanism of claim 9, wherein the supporting portion of the supporting member is able to be pressed against the guiding section in order to move along the guiding section and approach the first bent section gradually.

12. The retracting mechanism of claim 7, further comprising a buffer device arranged between the body and the catching member.

13. The retracting mechanism of claim 7, wherein the second direction and the first direction are opposite directions.

14. A retracting mechanism for a movable furniture part, applicable to a first furniture part and a second furniture part, wherein the first furniture part includes a fixing member, the second furniture part is movable in a first direction from a retracted position with respect to the first furniture part, and the retracting mechanism is arranged on the second furniture part, the retracting mechanism comprising:

a body including a first path and a second path, wherein the first path includes a guiding section, the guiding section includes a first end and a second end opposite the first end, there is a height difference between the first end and the second end, the first path further includes a first bent section adjacent to the second end of the guiding section, and the second path includes a linear section and a second bent section bent with respect to and in communication with the linear section;

a catching member, wherein the catching member and the body are movable with respect to each other through the second path, and the catching member is engaged with the fixing member of the first furniture part when the second furniture part is at the retracted position with respect to the first furniture part;

a connecting member, wherein the connecting member and the catching member are pivotally connected;

a supporting member, wherein the supporting member and the connecting member are pivotally connected, and the supporting member includes a supporting portion in the first path, the supporting member and the connecting member are pivotally connected by a pivotal connection portion, and the pivotal connection portion is in the second path; and a resilient member for applying an elastic restoring force and thereby retracting the second furniture part to the retracted position with respect to the first furniture part;

wherein the supporting portion of the supporting member is pivoted with respect to the connecting member from the guiding section of the first path of the body into engagement with the first bent section when the second furniture part reaches a first predetermined position with respect to the first furniture part by being moved in the first direction from the retracted position;

wherein the catching member is pivoted with respect to the connecting member, is thus disengaged from the fixing member of the first furniture part, and is moved from the linear section of the second path of the body into engagement with the second bent section to maintain the elastic restoring force of the resilient member, when the second furniture part reaches a second predetermined position with respect to the first furniture part by being further moved in the first direction from the first predetermined position, the elastic restoring force acting in a second direction.

15. The retracting mechanism of claim 14, wherein the guiding section is sloped.

16. The retracting mechanism of claim 14, wherein the connecting member and the catching member are pivotally connected by a shaft, and the shaft is in the second path.

* * * * *